US005842327A

United States Patent [19]

Schwede

[11] Patent Number: 5,842,327

[45] Date of Patent: Dec. 1, 1998

[54] CROSS STACKER WITH LOOPING ARRANGEMENT

[75] Inventor: Roland Schwede, Goldkronach, Germany

[73] Assignee: SMB Schwede Maschinenbau GmbH, Goldkronach, Germany

[21] Appl. No.: 834,868

[22] Filed: Apr. 10, 1997

[30] Foreign Application Priority Data

Apr. 16, 1996 [DE] Germany ..... 195 15 009.4

[51] Int. Cl.[6] ..... B65B 35/50; B65B 35/56; B65B 13/04

[52] U.S. Cl. ..... 53/540; 53/544; 53/589; 53/582; 100/26

[58] Field of Search ..... 53/582, 589, 540, 53/544; 100/25, 26

[56] References Cited

U.S. PATENT DOCUMENTS

| | | | |
|---|---|---|---|
| 3,566,780 | 3/1971 | Chisek | 100/26 |
| 3,701,314 | 10/1972 | Tull | 100/26 X |
| 3,831,512 | 8/1974 | Johnson | 100/26 |
| 4,292,785 | 10/1981 | Hammond | 53/589 X |
| 4,554,867 | 11/1985 | Thumm | 100/26 X |
| 5,353,576 | 10/1994 | Palamides et al. | 53/540 |
| 5,373,686 | 12/1994 | Lang et al. | 53/589 |
| 5,577,371 | 11/1996 | Lang et al. | 53/582 X |
| 5,680,813 | 10/1997 | Schwede | 53/589 X |

FOREIGN PATENT DOCUMENTS

| | | | |
|---|---|---|---|
| 37 42 787 | 6/1989 | Germany . | |
| 4001585 | 7/1991 | Germany | 53/589 |
| 19216 | 1/1990 | Japan | 100/26 |
| 4311405 | 11/1992 | Japan | 53/544 |
| 645857 | 10/1984 | Switzerland | 53/582 |

*Primary Examiner*—Linda Johnson
*Attorney, Agent, or Firm*—Browdy and Neimark

[57] ABSTRACT

A cross stacker comprising an integrated looping arrangement serves for alternate deposit of in particular folded printed products on a stack and for the subsequent looping of the stack with the help of a looping strip. Suitably, such a cross stacker is provided with a machine table, a working table, a rotary table integrated in the working table and having a catcher for the printed products to be stacked, and a looping arrangement, which is integrated in the cross stacker and which comprises an insertion, tensioning and welding device as well as a strip guide for the guidance of the inserted looping strip as a loose loop around the finished stack.

19 Claims, 8 Drawing Sheets

CROSS STACKER WITH LOOPING ARRANGEMENT

BACKGROUND OF THE INVENTION

1. Field of the Invention

The invention relates to a cross stacker comprising a looping arrangement for the alternate deposit of in particular folded printed products on a stack and for the subsequent looping of the stack by means of a looping strip.

2. Background Art

As regards the background of the invention, it must be explained that for the bundling and dispatching of folded printed products, which are thicker at their folded edge, it is often necessary or at least desirable to stack individual products or groups of few of them rotated relative to each other by 180°. This gives a uniform stack, i.e. this so-called cross stacking of folded articles compensates the increased space required by the folded edges in the direction of stacking and precludes a stack that is higher on one side. To this end, so-called cross stackers are utilized for the stacking of folded printed products. A serializer is disposed upstream of the cross stacker, dividing a continuous imbricated stream of folded printed products as it usually occasions in a printing plant into single products or individual groups. This serializer drops the printed products one after the other into a catcher of the cross stacker. The catcher is disposed on a rotary table and is rotated by 180° in the stacking plane after each dropping operation. This helps obtain the cross-stacking mentioned at the outset.

As a rule, a finished stack is discharged from the cross stacker by means of corresponding conveyor belts and conveyed to an adjacent looping, banding or welding device.

Problems are posed by the fact that the stack is conveyed without being secured—i.e. it is not held together by looping means—which, in particular with smooth printed products, often results in the products becoming misaligned in the stack or the whole stack collapsing.

To solve these problems, a cross stacker having an integrated banding device is disclosed by DE 37 42 787 C2. This device is critical in as much as the finished stack dives into the banding means, the banding strip being pulled up on two opposite sides of the stack by means of supporting rollers. Then welding dies connect the two lateral strands of strip and weld them.

In this case it is difficult to precisely position the rollers and welding dies for the formation of a tight banding loop.

SUMMARY OF THE INVENTION

It is the object of the invention to improve the looping arrangement integrated in the cross stacker.

According to the invention this object is attained in a cross stacker having an integrated looping arrangement by the features consisting in that in addition to the customary components such as a machine frame, a working table disposed thereon and a rotary table integrated in the working table and having a catcher for the printed products to be stacked, provision is made for a looping arrangement which comprises an insertion device for the insertion of the looping strip, a strip guide for the guidance of the inserted looping strip as a loose loop around the finished stack, and a tensioning and welding device, disposed under the working table, for tightening the loose loop around the stack and for connecting the lapping ends of the looping strip.

In keeping with a preferred embodiment, the strip guide has guide-passage sections in which the looping ship is guided mechanically. On the other hand provision is made in the strip guide for a free distance in air over which the leading end of the looping ship is shot. This free distance in air horizontally traverses the lifting range of the platform that comprises the catcher.

The described constructional design of the looping arrangement helps attain various advantages. Disposing the tensioning and welding device under the platform allows recourse to techniques that have proven successful in conventional looping arrangements and ensure high tensioning force as well as stable welds.

For the dropping of the printed products into the catcher and the discharge of the finished and looped stack to be rendered possible, a strip-guiding frame is used, which is disposed on the working table; it can be pivoted between a looping position and a position of release, it can be displaceable laterally or divided up into individual legs which free the respective dropping or discharge range.

However, the strip guide may also abandon the conventional looping technique, which per se proceeds from the above-mentioned strip-guiding frame that surrounds the stack to be looped and comprises an encircling guide passage, the looping strip being guided mechanically in both. Rather, then using an encircling frame as a strip-guide, one can use guide-passage sections on the one hand, in which the looping strip is mechanically guided, and a free distance in air on the other hand, over which the leading end of the looping strip is shot. The free distance in air horizontally traverses the lifting range of the platform comprising the catcher. As a direct consequence, no mechanical parts of the strip-guide are disposed in the area above the catcher, which might impede the dropping of the serialized printed products into the catcher. Summing up it can be said that contrary to the prior art, the cross stacker can be designed constructionally simple, needing less complex functional parts, because of the special design of the looping an arrangement.

Further features, details and advantages of the invention will become apparent from the ensuing description of preferred embodiments, taken in conjunction with the drawing.

DESCRIPTION OF THE PREFERRED EMBODIMENTS

Figure 1:
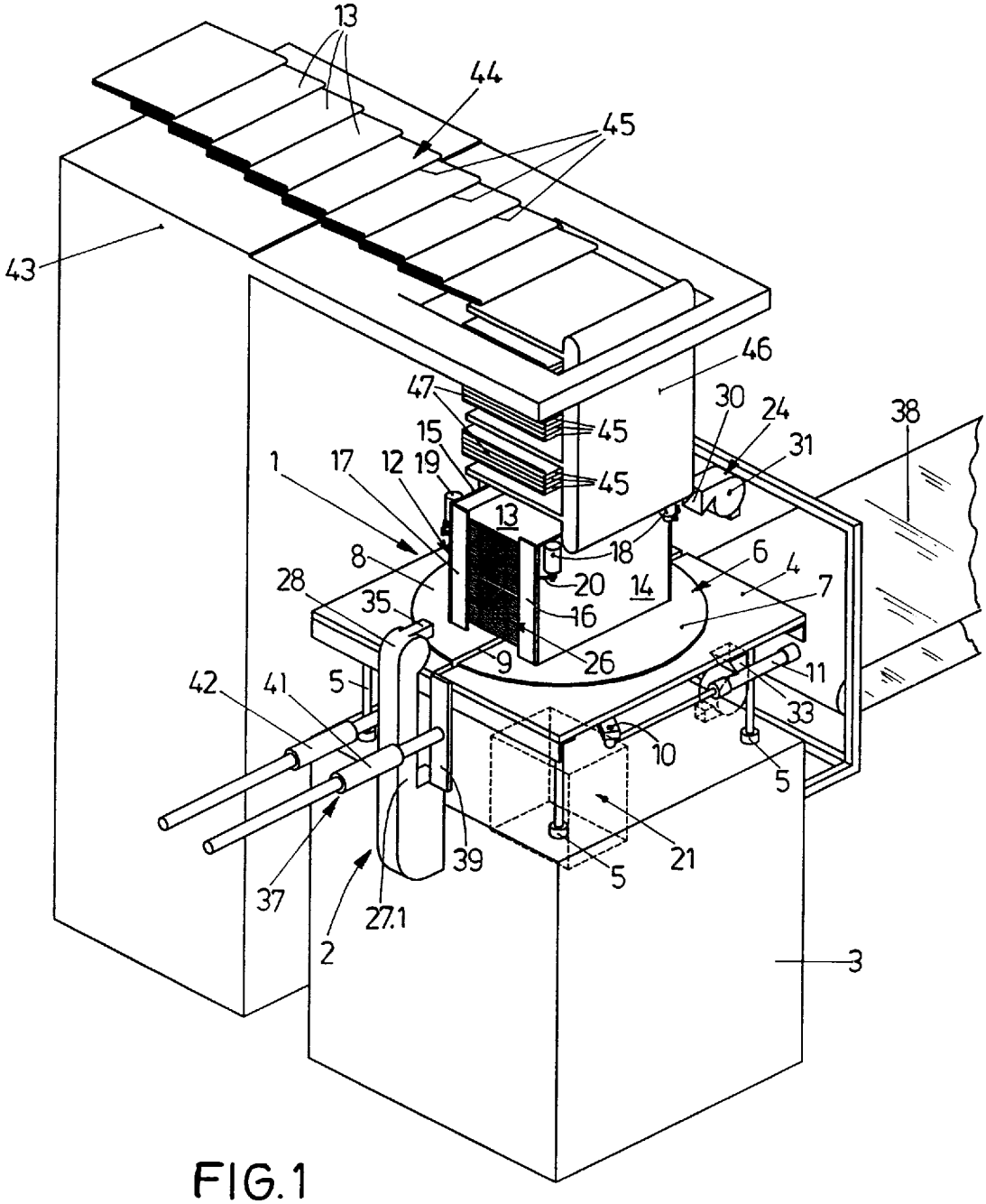
FIGS. 1 and 2 are diagrammatic, perspective illustrations of a cross stacker, in a first embodiment comprising an integrated looping arrangement in two different operating positions.
Figure 2:
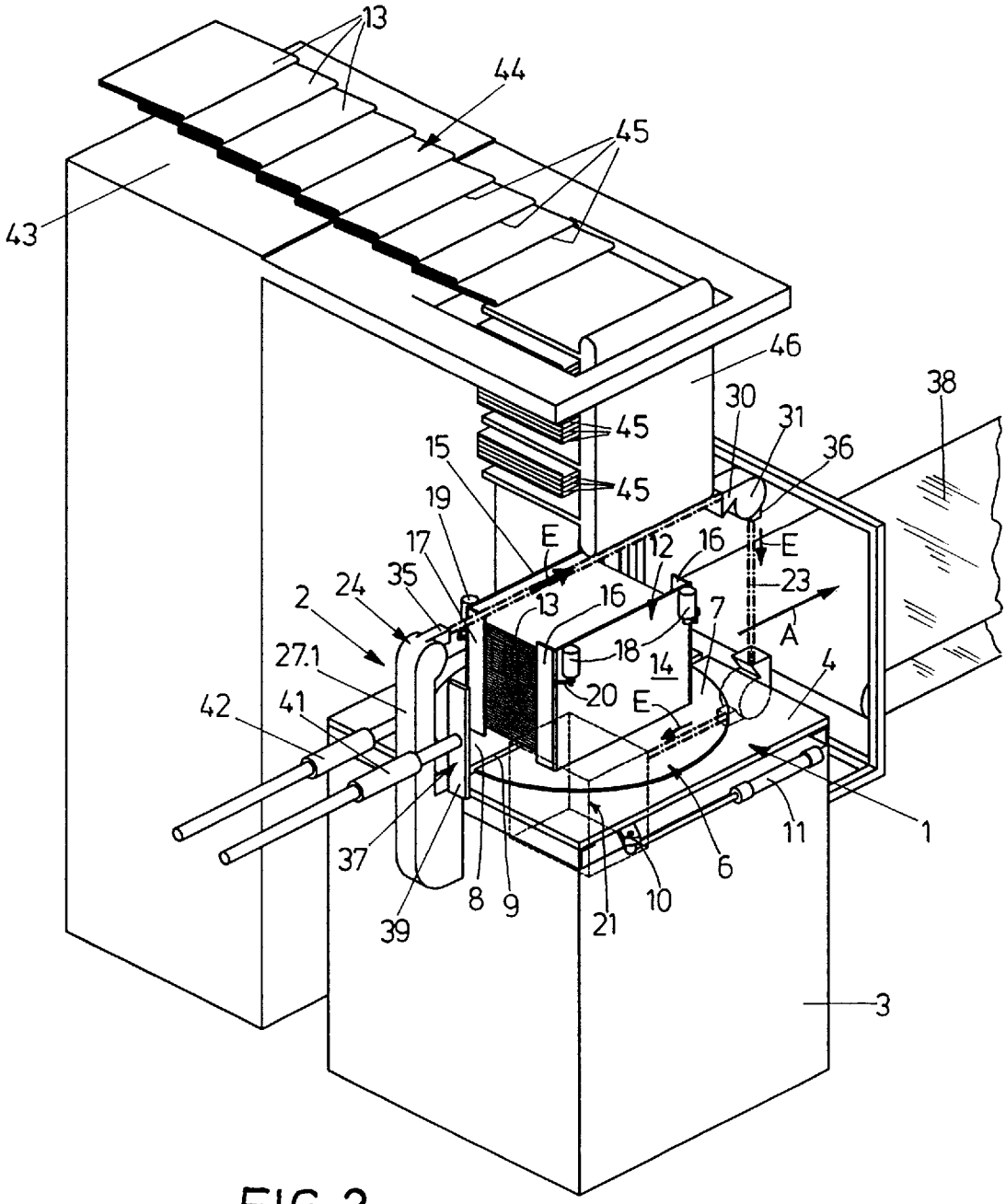
Figure 4:
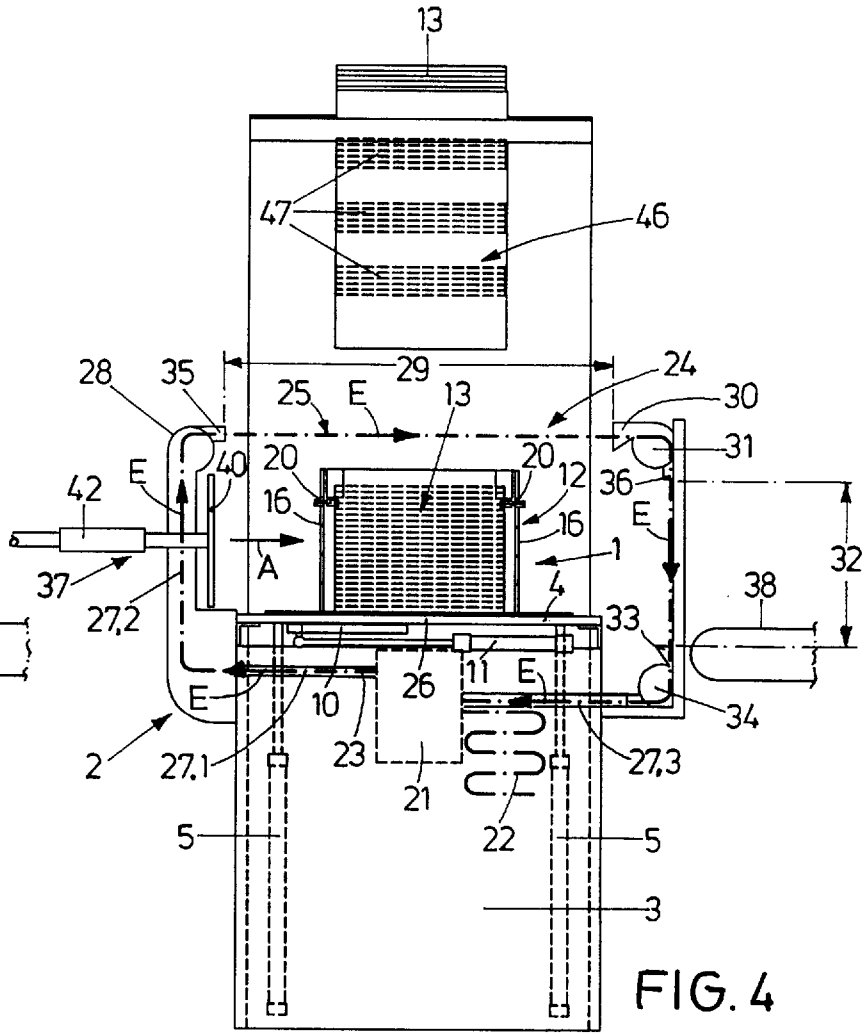
FIGS. 3 and 4 are diagrammatic lateral views of the arrangement by analogy to the operating positions of FIGS. 1 and 2, FIGS. 5 to 7 are diagrammatic perspective illustrations of cross stackers in further preferred embodiments.
Figure 3:
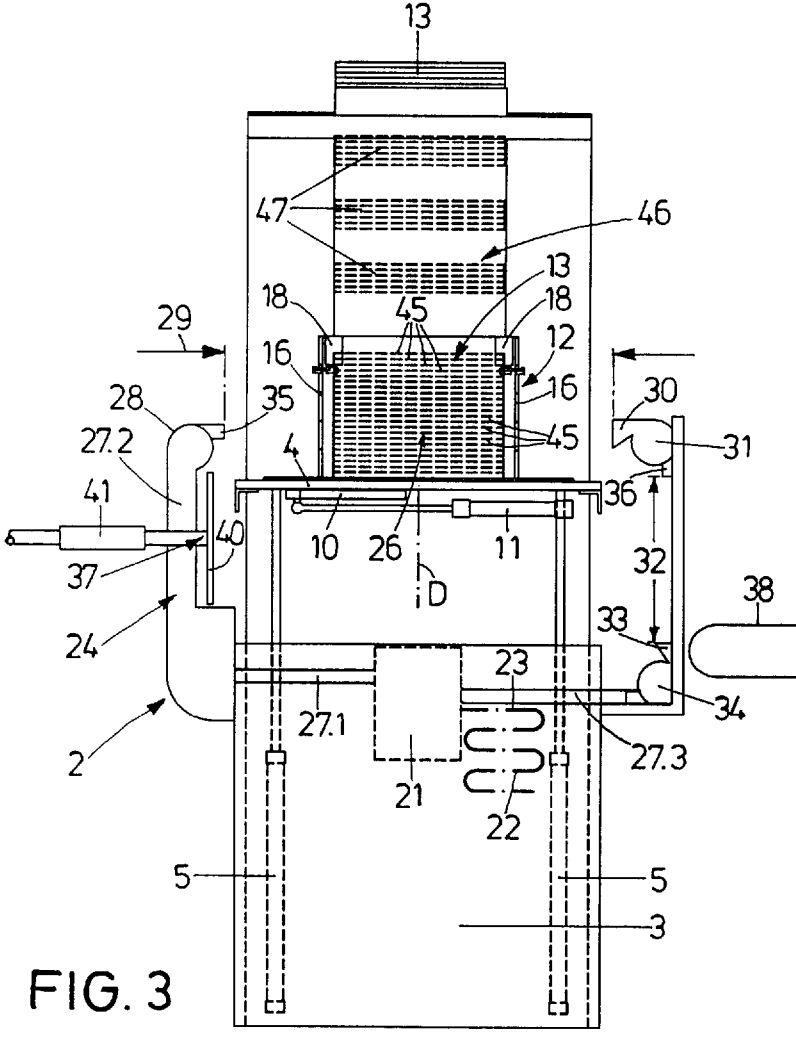

As seen in FIGS. 1 to 4, the cross stacker 1 comprising an integrated looping arrangement 2 has a machine table 3, on which is disposed a platform 4 to be lifted and lowered on the machine table 3. FIGS. 1 and 3 show the platform 4 in its lifted catching position, while FIGS. 2 and 4 show the lowered looping position.

For the lifting and lowering of the plate-shaped platform 4, which is about square in a plan view, vertically oriented piston-cylinder drives 5 are provided in the vicinity of the latter's four corners on the machine table 3; they are actuated by a compressed-air supply (not shown) and operated by a control (not shown). A rotary table 6 is integrated into the platform 4, consisting of two semi-circular sectors 7, 8. The two sectors 7, 8 are separated from each other by a spacing gap 9 which continues externally in the platform 4 and lies in the looping plane defined by the looping arrangement 2. By means of a pivoted lever 10 which can be operated by another piston-cylinder drive 11 on the platform 4, the rotary table 6 is rotatable by an angle of rotation of 180° about a vertical axis of rotation D (See FIG. 3). Further, the rotary table 6 is provided with a catcher 12 for the folded printed products 13 approaching on a printing gallery. As seen in FIGS. 1 and 2, the catcher 12 consists of two opposing and rigid side pieces 14, 15 designed as slabs in the embodiment shown. The side pieces 14, 15 may also be individual braces or lattice. For proper dropping of the printed products 13 that are to be deposited in the catcher 12, flaps 16, 17 are provided on the vertical edges of the side pieces 14, 15, standing out perpendicularly inward therefrom in a closing position. For it to be possible to pivot the flaps automatically outward out of this closing position shown in the figures, servomotors 18, 19 are provided on the outsides of the side pieces 14, 15; they are connected with the flaps 16, 17 via crank mechanisms 20.

The looping arrangement 2 integrated in the cross stacker 1 comprises an insertion, tensioning and welding device 21, which is diagrammatically outlined by a dashed box or rectangle in the attached figures and which is structured in the way of conventional looping technology. It is sufficient to mention that the looping strip 23 (dot-dashed in FIGS. 2 and 4) is supplied from a strip supply 22 and inserted into the strip guide 24 (to be specified below) by means of a pair of drive rollers, the inserted looping strip being placed as a loose loop 25 around the stack 26 of printed products 13. The leading end of the looping strip is held in the device 21 disposed under the platform 4, the looping strip 23 is tautened around the stack 26 by actuation, in the opposite direction, of the mentioned pair of drive rollers, and the lapping ends of the lopping strip are connected by the welding head in the device 21. The processes taking place in the device 21 are known technology and need no detailed explanation.

Substantial differences from the prior art reside in the strip guide 24. It has guide-passage sections 27.1, 27.2 and 27.3 in which the looping strip 23 is mechanically guided. As usually, these guide-passage sections are grooves suited to the cross-section of the looping strip 22 and provided, toward the inside—i.e. toward the stack 26—with a cover that can be opened. Once the cover is opened, the looping strip can be pulled inward, out of the guide-passage section, for the looping strip to be tightened around the stack 26.

The guide-passage sections are split up into a horizontal guide-passage section 27.1 adjoining the device 21 in the direction of insertion E and a subsequent, vertical guide-passage section 27.2 which leads upward on one side of the platform 4. The upper deflection 28 of the section 27.2 is followed by a free horizontal distance in air 29 over which the leading end of the looping strip 23 is shot for insertion. As seen in particular in a comparison of FIGS. 3 and 4, the free distance in air 29 horizontally traverses the lifting range of the platform 4 comprising the catcher 12.

At the end of the free distance in air 29 that is opposite to the guide-passage section 27.2, a first hopper-type catching arrangement 30 is provided, piloting the looping strip 23 to an intermediate drive 31 where the looping strip is seized and transported in the direction of insertion E as well as deflected vertically downward. The intermediate drive 31 is followed by another free distance in air 32 downward in the vertical direction on the side of the platform 4 that is opposite to the guide-passage section 27.2. Again, a hopper-type catching arrangement 33 having an intermediate drive 34 disposed downstream of it is provided at the lower end of this free distance in air 32 and serves to transport the looping strip 23 into the last mechanical guide-passage section 27.3 that leads to the device 21.

So as to aid in the insertion of the looping strip 23 over the free distances in air 29, 32, compressed-air nozzles 35, 36 are provided, generating a compressed-air jet along the free distances in air 29, 32 that pneumatically guides the looping strip. Detailed technical explanation of the type of strip guide 24 roughly described above, comprising mechanically working guide-passage sections and free distances in air 29 over which the looping strip 23 is shot, can be taken from the older U.S. patent application Ser. No. 08/591,834, the technical details of which on the strip guide are incorporated into the disclosure of the present application by way of reference.

On the side of the catcher 12 that is opposite to the vertical free distance in air 32, a discharge device 37 is provided, by means of which the looped stack 26 can be moved across the vertical free distance in air 32 onto a conveyor belt 38 for the stack to be discharged. To this end, the discharge device 37 has a pair of horizontally actuated slides 39, 40, which are disposed laterally beside the vertical guide-passage section 27.2 and can be displaced in the horizontal direction of discharge A by a telescopic drive 41, 42 diagrammatically outlined.

The operation of the cross stacker mentioned above is to be specified as follows:

The printed products 13 approaching as a continuous imbricated stream 44 on a gallery 43 are oriented with their fold 45 being turned always in the same direction. The serializer 46, which is diagrammatically outlined in FIGS. 1 to 4, divides the imbricated stream 44 into individual packages 47 of few printed products 13. As before, the folds 45 are turned in the same direction. The serializer 46 drops the individual packages 17 downward into the catcher 12 one after the other by distance of time. Between the package-47-dropping jobs, the rotary table 6 is rotated by means of the piston-cylinder drive 11 by 180° about the vertical axis of rotation D so that ultimately the stack 26 resting in the catcher 12 has folds 45 of alternate arrangement. This is outlined by dashes of different lengths in FIGS. 3 and 4. Dropping the packages 47 takes place with the platform 4 lifted as seen in FIGS. 1 and 3. Once the stack 26 has reached its desired height, the platform 4, in its catching position, is moved downward into its looping position so that the stack 26 is situated within the strip guide 24. A looping strip 23 is inserted, moving along the guide-passage sections 27.1, 27.2, over the free distances in air 29, 32 and finally into the guide-passage section 27.3 to arrive in the insertion/tensioning and welding device. As roughly outline above, the loose looping-strip loop is pulled out of the strip guide 24 and tightened around the stack 26. In this case, the looping strip passes through the spacing gap 9 and between the flaps 16, 17, directed inward, of the catcher 12.

After the welding of the looping strip, the finished and looped stack 26 is moved by the discharge device 37 onto the conveyor belt 38, the flaps 16, 17 being moved, by the aid of the servomotors 18, 19, into a position parallel to the side pieces 14, 15 and the catcher 12 thus being opened. The slides 39, 40 can reach into the catcher 12 and transport the stack 26 in the direction of discharge A out of the catcher 12 and onto the conveyor belt 38. Then the slides 39, 40 are withdrawn and the flaps 16, 17 are closed again. Further, the platform 4 is moved upward, upon which the next cross-stacking job of the individual packages 47 may take place.

Figure 5:
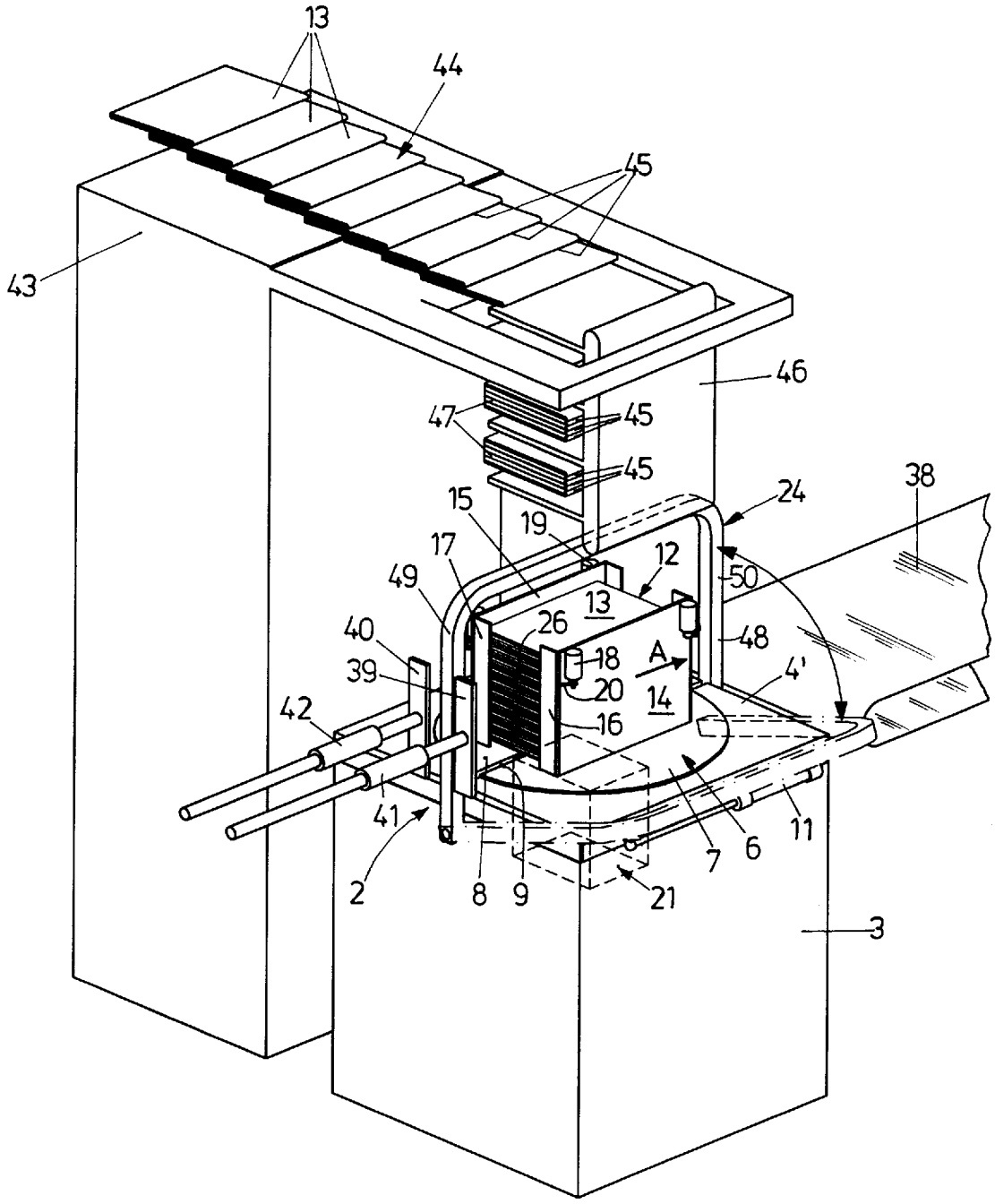
Figure 6:
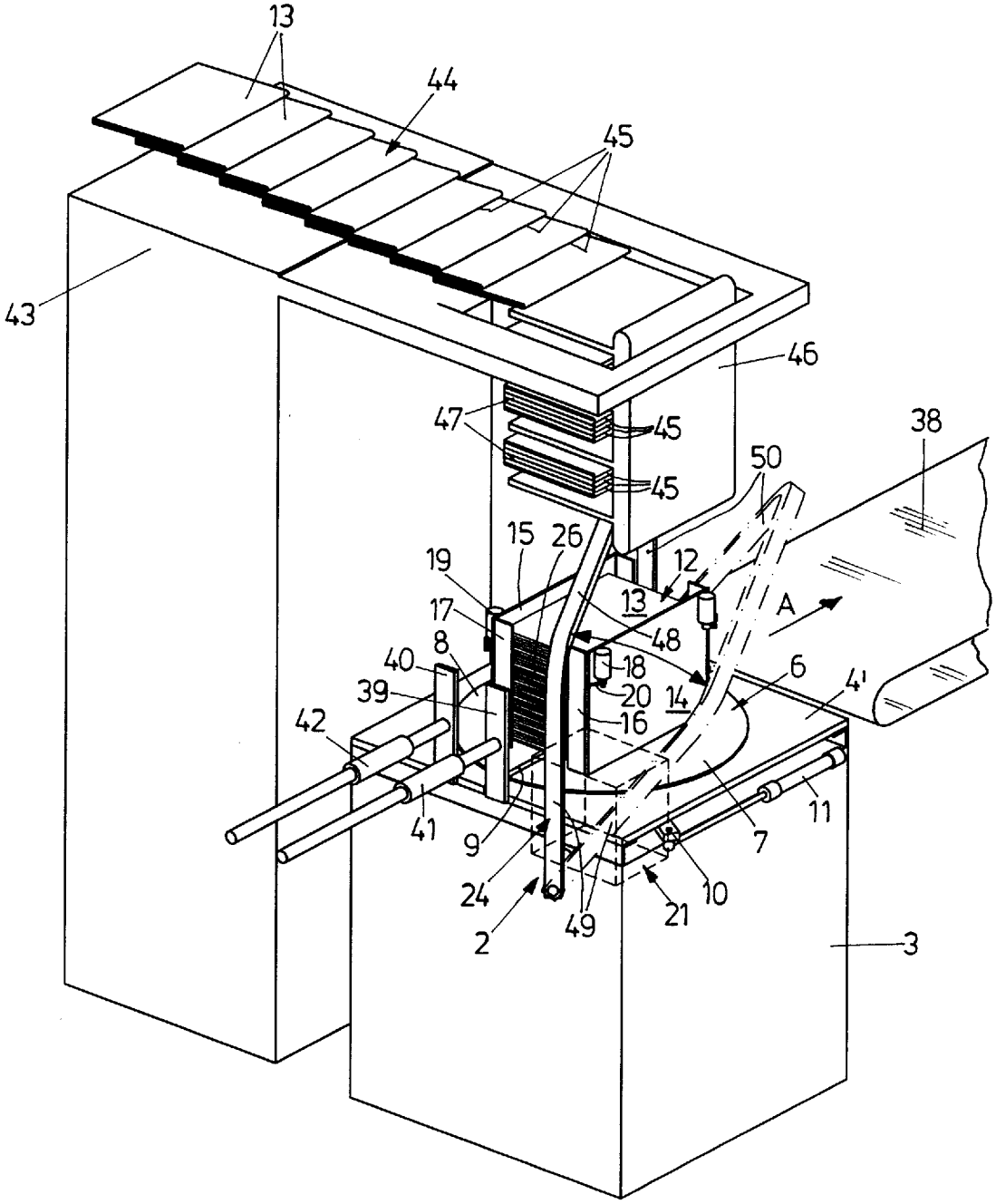
Figure 7:
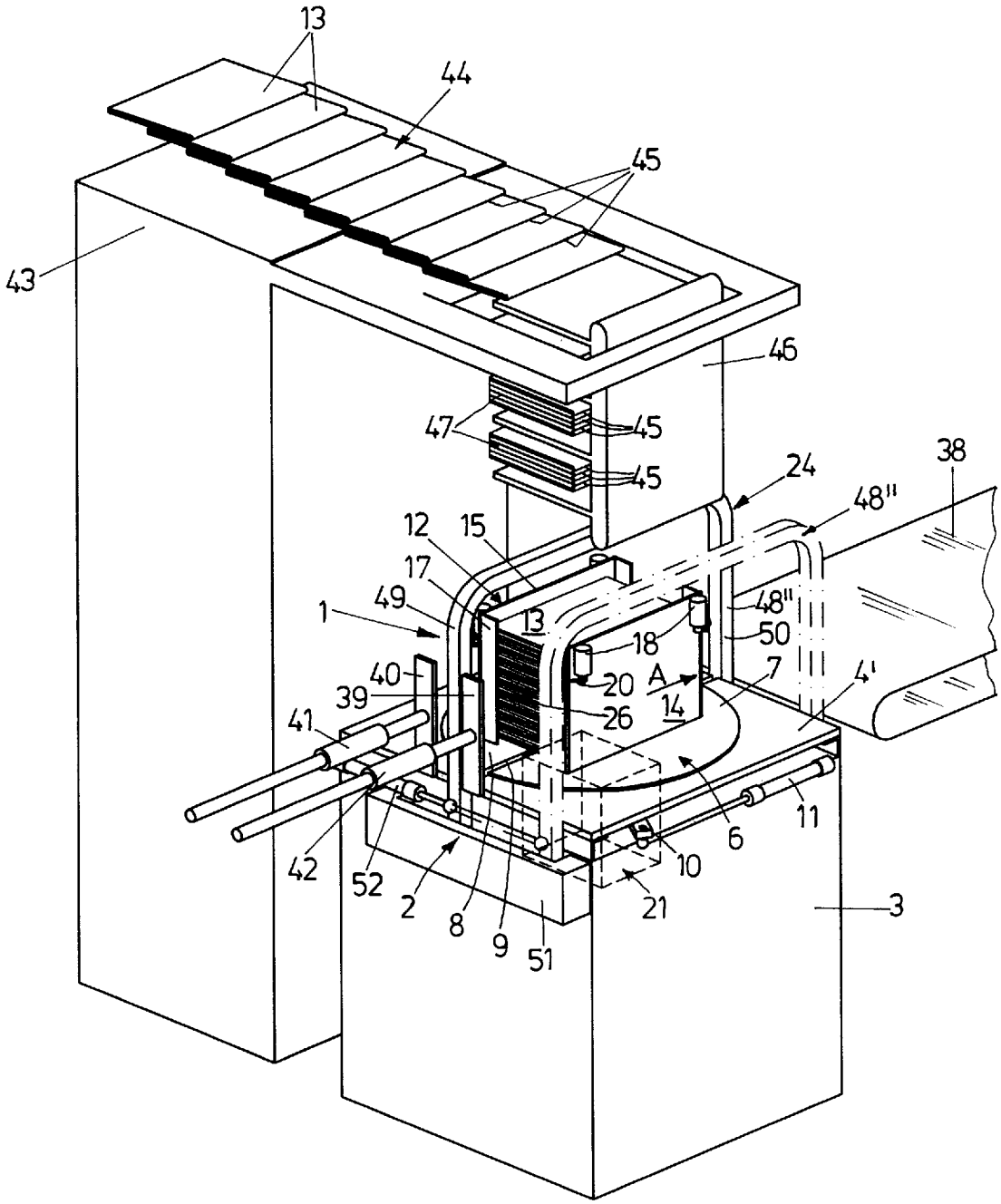

The embodiments of the cross stacker 1 according to FIGS. 5 to 7 differ from the cross stacker mentioned above according to FIGS. 1 to 4 substantially in the way the rotary table is supported and the strip guide 24 is designed. For instance, the rotary table 6 is not supported on a platform that can be lifted or lowered, but on a working table 4' stationarily disposed on the machine table 3. Underneath, there is again the combined insertion/tensioning and welding device 21, which is connected with the guide-passage sections 27.1 and 27.3 (not shown in FIGS. 5 to 7) under the spacing gap 9.

In the embodiment according to FIG. 5, the strip guide 24 is completed by a strip-guiding frame 48, which has the shape of a U standing upside down. At the free ends of the vertical legs of the U 49, 50, the strip-guiding frame 48 is supported pivotably about a horizontal axis that aligns with the spacing gap 9 so that the ship-guiding frame 48 can be pivoted from the position of looping shown by a solid line in FIG. 5 into the position of release shown by dot-dashes. In this position, the packages 47 can be dropped by the serializer 46 downward into the catcher 12, the rotary table 6 being rotated as described by 180° between each dropping of a package. As soon as the catcher 12 is filled, the ship-guiding frame 48 is folded up, out of the position of release, into the looping position and a looping operation can be performed in the usual way. Then the ship-guiding frame 48 is again pivoted into the position of release, the two slides 39, 40 being able to move the looped stack 26 onto the conveyor belt 38.

Component parts that are identical with the embodiment according to FIGS. 1 to 4 have identical reference numerals in FIGS. 5 to 7 and need no renewed explanation.

In the embodiment seen in FIG. 6, the strip-guiding frame 48' is again vertical, but inclined in relation to the direction of discharge A, so that the two vertical legs 49, 50 of the U are located outside the sliding path of the stack 26 and the slides 39, 40. Consequently, the strip-guiding frame 48' has to be pivoted into the dot-dashed position of release only when the packages 47 are dropped into the catcher 12. After its being folded up into the looping position shown by a solid line and after the looping of the stack 26, discharge of the stack 26 can take place immediately, which increases the clock rate and thus the operating speed of the cross stacker.

In the embodiment of FIG. 7, the strip-guiding frame 48" is designed by analogy to FIG. 5 to be slidable laterally out of the looping position shown by a solid line into the dot-dashed position of release, instead of being pivoted. To this end, the free ends of the vertical legs 49, 50 of the U are displaceably guided in transverse guides 51. Again, driving is effected by corresponding piston-cylinder drives 52.

Figure 9:
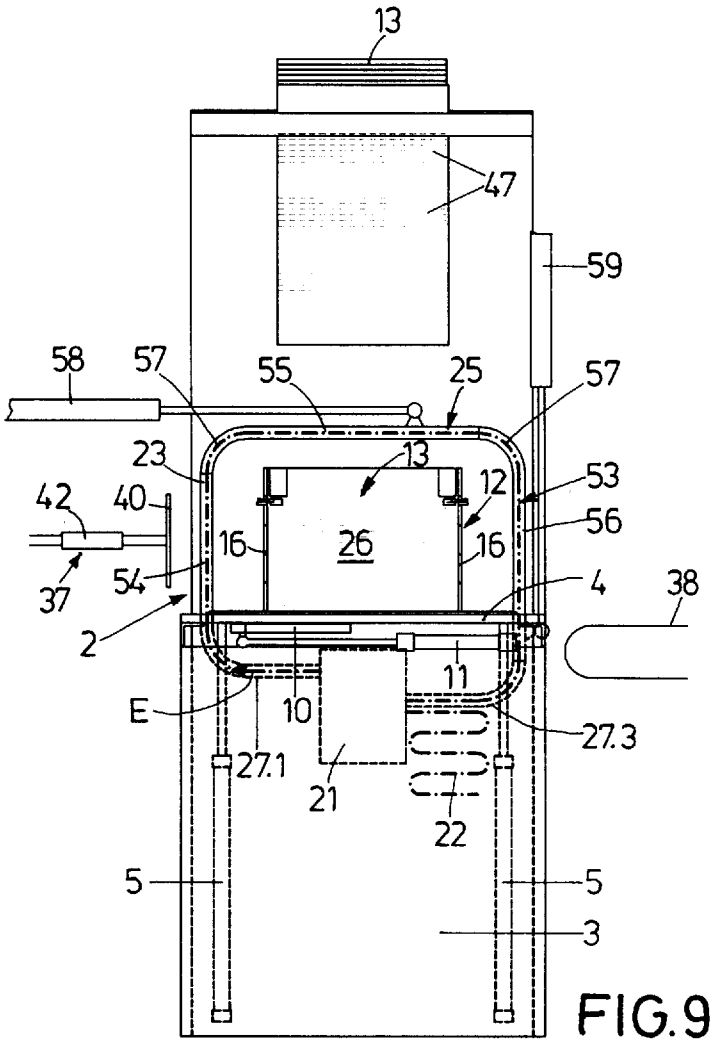
FIGS. 8 to 10 are diagrammatic lateral views of another embodiment of a cross stacker in successive operating positions.
Figure 8:
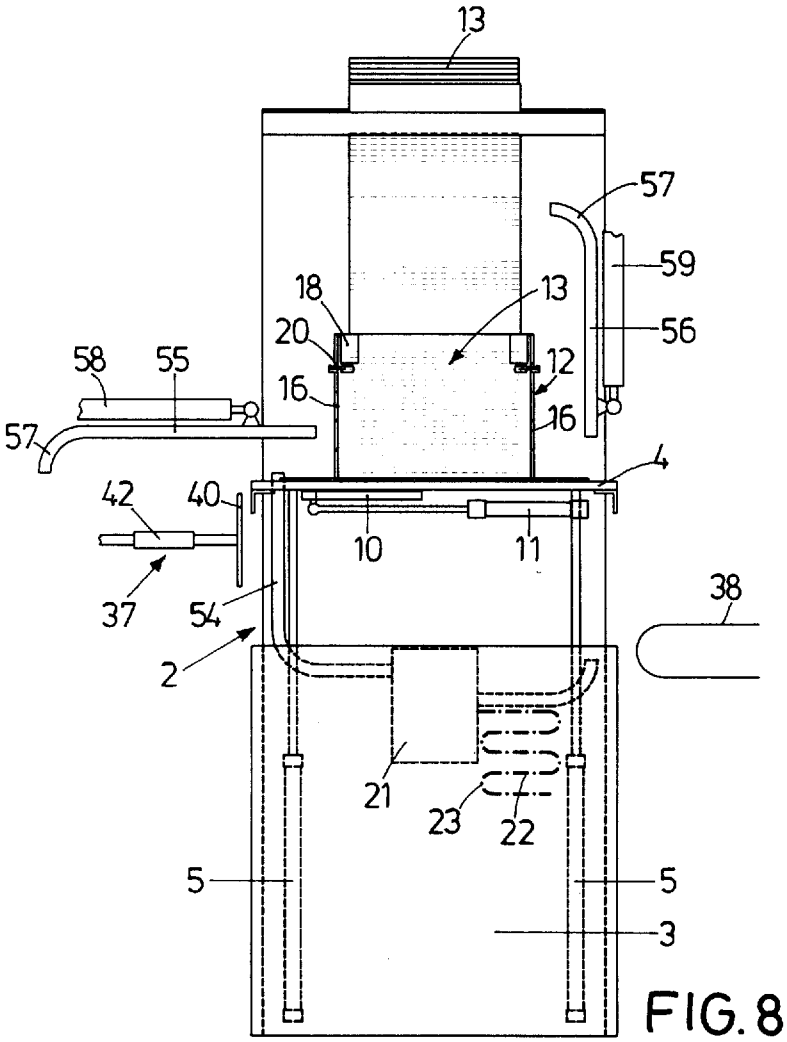
Figure 10:
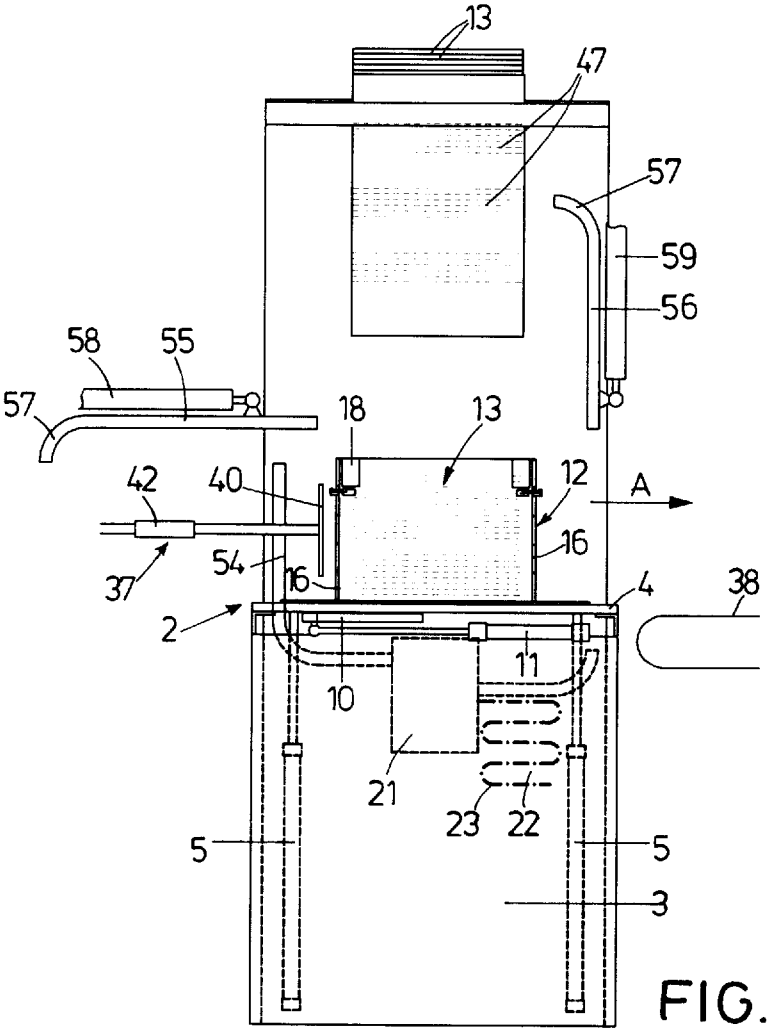

The embodiment seen in FIGS. 8 to 10 differs from the cross stacker according to FIGS. 1 and 4 only in the design of the strip guide 24. Otherwise, identical components again have identical reference numerals and need no renewed explanation.

The mentioned strip guide 24 of the embodiment according to FIGS. 8 to 10 has a structured, U-shaped strip-guiding frame 53. It consists of a vertical, stationary leg 54 that follows the guide-passage section 27.1, a horizontal leg 55 that forms the U-base, and another vertical leg 56, both legs 55, 56 being provided with curved transition pieces 57. The legs 55 and 56 are movable by means of a respective piston-cylinder drive 58, 59 to reciprocate horizontally or vertically from the looping position seen in FIG. 9 into a position of release. In the position of release seen in FIG. 8, the horizontal leg 55 is pulled horizontally outward. The vertical leg 56 is pulled horizontally upward. The platform 4 is lifted and the packages 47 are dropped from the serializer 46 into the catcher 12, the platform 4 succesively moving downward. As soon as the catcher 12 is filled, the platform 4 moves downward into the position seen in FIG. 9. Simultaneously, the horizontal leg 55 and the vertical leg 56 are slipped inward or downward, respectively, until cooperating with the stationary leg 54 to form the strip-guiding frame 53. The looping operation for the bundling of the stack 26 can be carried out as usually. Then the horizontal leg 55 and the vertical leg 56 move back outward or upward, respectively, and the two slides 39, 40 can slip the package 26 in the discharge direction A onto the conveyor belt 38.

What is claimed is:

1. A combined cross stacker and looping arrangement for an alternate deposit of printed products (13) on a stack (26) and for a subsequent looping of the stack (26) by means of a looping strip (23), comprising:

a machine table (3), a working table (4, 4') disposed on the machine table (3), a rotary table (6), which is integrated in the working table (4, 4') and has a catcher (12) for the printed products (13) to be stacked, a looping arrangement integrated in the cross stacker and comprising an insertion device (21) for an insertion of the looping strip (23), a strip guide (24) for a guidance of the inserted looping strip (23) as a loose loop (25) around the finished stack (26), and a tensioning and welding device (21), disposed under the working table (4, 4'), for tightening the loose loop (25) around the stack (26) and connecting the lapping end of the looping strip.

2. A combined cross stacker and looping arrangement according to claim 1, wherein the working table is a platform (4), which is disposed on the machine table (3) to be lifted and lowered between a lifted catching position and a lowered looping position.

3. A combined cross stacker and looping arrangement according to claim 1, wherein the strip guide (24) comprises guide-passage sections (27), in which the looping strip (23) is mechanically guided, and a free distance in air (29), over which a leading end of the looping strip (23) is inserted horizontally traversing a lifting range of the working table (4, 4') with the catcher (12).

4. A combined cross stacker and looping arrangement according to claim 3, comprising a vertically oriented guide-passage section (27.1) on one side of the working table (4, 4') with the catcher (12), a horizontally oriented guide-passage section (27.2, 27.3) under the working table (4, 4'), and in addition to the horizontal free distance in air (29), another free distance in air (32) in the vertical direction on such side of the strip guide (24) as is opposite to the vertically oriented guide-passage section (27.1).

5. A combined cross stacker and looping arrangement according to claim 4, wherein on the side opposite to the vertical free distance in air (32), a discharge device (37) is provided, by means of which the looped stack (26) is movable across the vertical free distance in air (32) onto a conveying device (38).

6. A combined cross stacker and looping arrangement according to claim 5, wherein the discharge device (37) is formed by a pair of horizontally actuated slides (39, 40) disposed laterally beside the strip guide (24).

7. A combined cross stacker and looping arrangement according to claim 3, wherein for aiding in the insertion of the looping strip (23) along the free distances in air (29), the strip guide (24) comprises a compressed-air nozzle (35, 36) for the generation of a compressed-air jet along the free distance in air (29) that pneumatically guides the looping strip (23).

8. A combined cross stacker and looping arrangement according to claim 3, wherein at least one of a catching arrangement (33) and an intermediate drive (34) for the looping strip (23) is disposed at the end of the free distance in air (29).

9. A combined cross stacker and looping arrangement according to claim 1, wherein the catcher (12) comprises two rigid side pieces (14, 15), which oppose each other and which are completed by pivoted flaps (16, 17) articulated to them and pivotable between a closed position for the proper collecting of printed products (13) and an open position removing the stack (26) of printed products.

10. A combined cross stacker and looping arrangement according to claim 1, wherein the strip guide (24) has a substantially U-shaped strip-guiding frame (48, 48', 48", 53), which extends above the working table (4, 4') and which is movable to reciprocate between a position of looping and a position of release for a dropping of the printed products (13) and the discharge of the stack (26).

11. A combined cross stacker and looping arrangement according to claim 10, wherein the strip-guiding frame (48, 48') can be pivoted in its entirety from a vertical looping position into an approximately horizontal position of release.

12. A combined cross stacker and looping arrangement according to claim 10, wherein the strip-guiding frame (48") is slidable from a vertical looping position laterally into a position of release.

13. A combined cross stacker and looping arrangement according to claim 10, wherein the strip-guiding frame (53) is composed of several legs (54, 55, 56), of which at least one (55, 56) is separately movable between a looping position and a position of release.

14. A combined cross stacker and looping arrangement according to claim 4, wherein for aiding in the insertion of the looping strip (23) along the free distances in air (29, 32), the strip guide (24) comprises compressed-air nozzles (35, 36) for the generation of a compressed-air jet along the free distances in air (29, 32) that pneumatically guides the looping strip (23).

15. A combined cross stacker and looping arrangement according to claim 4, wherein at least one of a catching arrangement (33) and an intermediate drive (34) for the looping strip (23) is disposed at the end of the free distances in air (29, 32).

16. A cross stacker and a looping arrangement for an alternate deposit of printed products (13) on a stack (26) and a for subsequent looping of the stack (26) by means of a looping strip (23), comprising:

a machine table (3), a working table (4, 4') disposed on the machine table (3), a rotary table (6), which is integrated in the working table (4, 4') and has a catcher (12) for the printed products (13) to be stacked, a looping arrangement integrated in the cross stacker and comprising an insertion device (21) for an insertion of the looping strip (23), a strip guide (24) for a guidance of the inserted looping strip (23) as a loose loop (25) around the finished stack (26), and a tensioning and welding device (21), disposed under the working table (4, 4,'), for tightening the loose loop (25) around the stack (26) and connecting the lapping end of the looping strip, wherein the strip guide (24) comprises guide-passage sections (27), in which the looping strip (23) is mechanically guided, and a free distance in air (29), over which a leading end of the looping strip (23) is inserted horizontally traversing a lifting range of the working table (4, 4') with the catcher (12).

17. A cross stacker and a looping arrangement for an alternate deposit of printed products (13) on a stack (26) and a for subsequent looping of the stack (26) by means of a looping strip (23), comprising:

a machine table (3), a working table (4, 4') disposed on the machine table (3), a rotary table (6), which is integrated in the working table (4, 4') and has a catcher (12) for the printed products (13) to be stacked, a looping arrangement integrated in the cross stacker and comprising an insertion device (21) for an insertion of the looping strip (23), a strip guide (24) for a guidance of the inserted looping strip (23) as a loose loop (25) around the finished stack (26), and a tensioning and welding device (21), disposed under the working table (4, 4,'), for tightening the loose loop (25) around the stack (26) and connecting the lapping end of the looping strip, wherein the strip guide (24) comprises guide-passage sections (27), in which the looping strip (23) is mechanically guided, and a free distance in air (29), over which a leading end of the looping strip (23) is inserted horizontally traversing a lifting range of the working table (4, 4') with the catcher (12), comprising a vertically oriented guide-passage section (27.1) on one side of the working table (4, 4') with the catcher (12), a horizontally oriented guide-passage section (27.2, 27.3) under the working table (4, 4'), and in addition to the horizontal free distance in air (29), another free distance in air (32) in the vertical direction on such side of the strip guide (24) as is opposite to the vertically oriented guide-passage section (27.1).

18. A cross stacker and a looping arrangement for an alternate deposit of printed products (13) on a stack (26) and a for subsequent looping of the stack (26) by means of a looping strip (23), comprising:

a machine table (3), a working table (4, 4') disposed on the machine table (3), a rotary table (6), which is integrated in the working table (4, 4') and has a catcher (12) for the printed products (13) to be stacked, a looping arrangement integrated in the cross stacker and comprising an insertion device (21) for an insertion of the looping strip (23), a strip guide (24) for a guidance of the inserted looping strip (23) as a loose loop (25) around the finished stack (26), and a tensioning and welding device (21), disposed under the working table (4, 4,'), for tightening the loose loop (25) around the stack (26) and connecting the lapping end of the looping strip, wherein the catcher (12) comprises two rigid side pieces (14, 15), which oppose each other and which are completed by pivoted flaps (16, 17) articulated to them.

19. A cross stacker and a looping arrangement for an alternate deposit of printed products (13) on a stack (26) and a for subsequent looping of the stack (26) by means of a looping strip (23), comprising:

a machine table (3), a working table (4, 4') disposed on the machine table (3), a rotary table (6), which is integrated in the working table (4, 4') and has a catcher (12) for the printed products (13) to be stacked, a looping arrangement integrated in the cross stacker and comprising an insertion device (21) for an insertion of the looping strip (23), a strip guide (24) for a guidance of the inserted looping strip (23) as a loose loop (25) around the finished stack (26), and a tensioning and welding device (21), disposed under the working table (4, 4,'), for tightening the loose loop (25) around the stack (26) and connecting the lapping end of the looping strip, wherein the strip guide (24) has a substantially U-shaped strip-guiding frame (48, 48', 48", 53), which extends above the working table (4, 4') and which is movable to reciprocate between a position of looping and a position of release for a dropping of the printed products (13) and the discharge of the stack (26).

* * * * *

UNITED STATES PATENT AND TRADEMARK OFFICE

CERTIFICATE OF CORRECTION

PATENT NO. : 5,842,327
DATED : Dec. 1, 1998
INVENTOR(S) : Roland Schwede

It is certified that error appears in the above-identified patent and that said Letters Patent is hereby corrected as shown below:

Cover page, line [30], under Foreign Application Priority Data, delete "195 15 009.4" and insert therefor --196 15 009.4--.

Signed and Sealed this

Eighteenth Day of May, 1999

*Attest:*

Q. TODD DICKINSON

*Attesting Officer*

*Acting Commissioner of Patents and Trademarks*